US008542856B2

(12) United States Patent
Nakatoh et al.

(10) Patent No.: US 8,542,856 B2
(45) Date of Patent: Sep. 24, 2013

(54) HEARING AID

(75) Inventors: Yoshihisa Nakatoh, Kanagawa (JP); Makoto Nishizaki, Tokyo (JP)

(73) Assignee: Panasonic Corporation, Osaka (JP)

( * ) Notice: Subject to any disclaimer, the term of this patent is extended or adjusted under 35 U.S.C. 154(b) by 111 days.

(21) Appl. No.: 13/125,122

(22) PCT Filed: Dec. 1, 2010

(86) PCT No.: PCT/JP2010/007016
§ 371 (c)(1),
(2), (4) Date: Apr. 20, 2011

(87) PCT Pub. No.: WO2011/067928
PCT Pub. Date: Jun. 9, 2011

(65) Prior Publication Data

US 2012/0020506 A1 Jan. 26, 2012

(30) Foreign Application Priority Data

Dec. 2, 2009 (JP) ..... 2009-274106
Jan. 19, 2010 (JP) ..... 2010-008767

(51) Int. Cl.
*H04R 25/00* (2006.01)

(52) U.S. Cl.
USPC ..... 381/321; 381/312; 381/328

(58) Field of Classification Search
USPC ..... 381/312–331
See application file for complete search history.

(56) References Cited

U.S. PATENT DOCUMENTS 5,044,373 A 9/1991 Northeved et al.
6,094,489 A 7/2000 Ishige et al.
7,082,205 B1 7/2006 Westermann (Continued)

FOREIGN PATENT DOCUMENTS

AU 755661 5/2000
CA 2 344 823 5/2000

(Continued)

OTHER PUBLICATIONS

The Extended European Search Report dated Mar. 16, 2012 for the corresponding EP Application No. 10821453.7.

(Continued)

*Primary Examiner* — Duc Nguyen
*Assistant Examiner* — Matthew Eason
(74) *Attorney, Agent, or Firm* — Panasonic Patent Center

(57) ABSTRACT

In a hearing aid (100), a control device (4) comprises a transmission characteristic calculator (18), a correction characteristic calculator (21), and a correction component (17). The transmission characteristic calculator (18) calculates an at-fitting transmission characteristic Gf (ω) on the basis of correction-use sound data and first sound data produced by collection at an ear canal microphone (10) of correction-use sound outputted from a receiver (3) during fitting. The transmission characteristic calculator (18) calculates an in-usage transmission characteristic Gu (ω) on the basis of correction-use sound data and third sound data produced by collection at the ear canal microphone (10) of correction-use sound outputted from the receiver (3) according to user operation after fitting. The correction characteristic calculator (21) calculates a correction characteristic H (ω) on the basis of the at-fitting transmission characteristic Gf (ω) and the in-usage transmission characteristic Gu (ω). The correction component (17) corrects input sound data that has undergone hearing aid processing by a hearing aid processor (16) on the basis of the correction characteristic H (ω).

5 Claims, 15 Drawing Sheets

(56) References Cited

U.S. PATENT DOCUMENTS

| | | | | |
|---|---|---|---|---|
| 2005/0123146 | A1 | 6/2005 | Voix et al. | |
| 2005/0147266 | A1 | 7/2005 | Eggers et al. | |
| 2008/0107287 | A1 | 5/2008 | Beard | |
| 2008/0219486 | A1 | 9/2008 | Goldstein et al. | |
| 2009/0245530 | A1 | 10/2009 | Keady | |
| 2010/0246869 | A1 * | 9/2010 | Zhang et al. | 381/320 |

FOREIGN PATENT DOCUMENTS

| | | |
|---|---|---|
| EP | 0 381 608 | 8/1990 |
| EP | 1 129 601 | 9/2001 |
| JP | 3-7498 | 1/1991 |
| JP | 10-94095 | 4/1998 |
| JP | 2002-530033 | 9/2002 |
| WO | 00-28783 | 5/2000 |

OTHER PUBLICATIONS

International Search Report of PCT Application No. PCT/JP2010/007016, mailed on Jan. 11, 2011.

English Translation of Written Opinion of the International Searching Authority (PCT/ISA/237), for corresponding PCT application No. PCT/JP2010/007016, mailed on Jan. 11, 2011.

* cited by examiner

Spectrum of receiver output sound: X (ω)

Spectrum of external microphone: X (ω)

Spectrum of ear canal sound: Yf (ω)

Spectrum of ear canal sound: Yu (ω)

Spectrum of external microphone: X (ω)

Spectrum of ear canal microphone: Yf (ω)

Spectrum of external microphone: X (ω)

HEARING AID

TECHNICAL FIELD

The present invention relates to a hearing aid.

Background Art

A hearing aid comprises a receiver that the user mount in the inlet to the ear canal or inserts into the ear canal, a control device that is connected to the receiver, and an external microphone that is connected to the control device. The hearing aid uses the control device to perform hearing aid processing on sound collected by the external microphone, and then supplies this sound to the ear canal through the receiver. The hearing aid processing performed by the control device is carried out according to the hearing aid function settings made during fitting prior to use of the hearing aid. As is well known, these hearing aid function settings during fitting are made according to how the user hears successively outputted sounds over the audible frequency band, such as from low sounds to high sounds. However, even though the hearing aid function setting has been performed, the hearing aid function may not be properly realized depending on the usage environment of the hearing aid (such as how it is mounted).

In view of this, Patent Literature 1 below proposes that hearing aid processing (amplification) be performed by a control device so that the sound pressure collected by the ear canal microphone will be constant, on the basis of the result of comparing the sound pressure of sound collected by the external microphone to the sound pressure collected by the ear canal microphone, during fitting before the hearing aid is used.

CITATION LIST

Patent Literature

Patent Literature 1: Japanese Laid-Open Patent Application H3-007498

SUMMARY

Technical Problem

However, the hearing aid processing discussed in Patent Literature 1 merely involves keeping the sound pressure constant, so when the user puts on the hearing aid the day after its fitting, for example, how the user hears sounds may be very different from that during fitting the day before, and this often causes the user discomfort.

This point will now be described in further detail. The mounting position of the hearing aid may become slightly offset every time it is attached, and this tiny difference in the mounting position of the hearing aid results in a volume difference within the ear canal between the receiver and the ear drum. This is easy to understand when considering a type of hearing aid in which the receiver is inserted into ear canal; the more deeply the receiver is inserted into the ear canal, the smaller is the volume inside the ear canal, and conversely the more shallowly the receiver is inserted into the ear canal, the larger is the volume inside the ear canal. This fluctuation in the volume inside the ear canal directly affects the acoustic characteristics (that is, the frequency characteristics). In particular, the distance from the receiver to the ear drum tends to vary with the position at which the receiver is inserted into the ear canal deviates, so the sound pressure fluctuation caused by ear canal resonance and distance attenuation has a strong effect. Therefore, since situations in which the characteristics at the time of fitting adjustment cannot necessarily be obtained, the user's hearing (sound quality) may seem to be very different from that during fitting the day before. As a result, the user's satisfaction with respect to hearing ends up being low.

It is an object of the present invention to provide a hearing aid with which it is possible to suppress fluctuation in the acoustic characteristics (that is, frequency characteristics) caused by slight deviation in the mounting position of the hearing aid.

Solution to Problem

The hearing aid pertaining to the present invention comprises an external microphone that collects sound outside the ear canal, an ear canal microphone that collects sound inside the ear canal, a hearing aid processor that subjects input sound data indicating the sound collected by the external microphone to hearing aid processing on the basis of fitting information that has been set by fitting, a correction-use sound output component that outputs correction-use sound on the basis of correction-use sound data, an interface that is operated by a user, a transmission characteristic calculator that calculates an at-fitting transmission characteristic on the basis of first sound data produced by collection at the ear canal microphone of the correction-use sound outputted from the correction-use sound output component during fitting, and second sound data corresponding to the correction-use sound data, the transmission characteristic calculator configured to calculate an in-usage transmission characteristic on the basis of third sound data produced by collection at the ear canal microphone of the correction-use sound outputted from the correction-use sound output component according to user operation after fitting, and fourth sound data corresponding to the correction-use sound data, a correction characteristic calculator that calculates a correction characteristic on the basis of the at-fitting transmission characteristic and the in-usage transmission characteristic, and a correction component that corrects the input sound data that has undergone hearing aid processing by the hearing aid processor, on the basis of the correction characteristic.

Advantageous Effects

With the present invention, a hearing aid can be provided with which it is possible to suppress fluctuation in the acoustic characteristics (that is, frequency characteristics) caused by slight deviation in the mounting position of the hearing aid.

DESCRIPTION OF EMBODIMENTS

Embodiments of the present invention will now be described through reference to the appended drawings.

First Embodiment

Configuration of Hearing Aid 100

Figure 1:
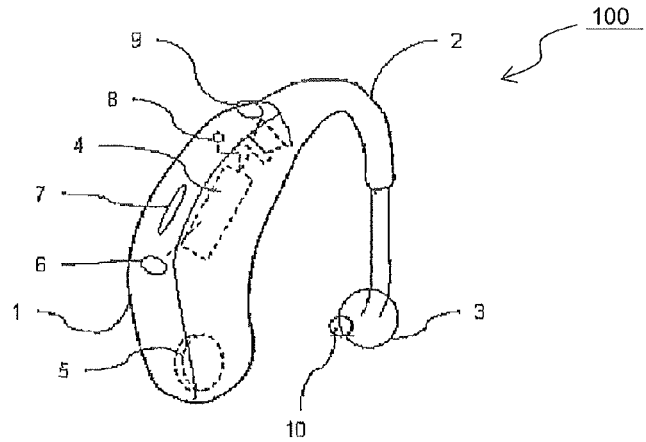
FIG. 1 is an oblique view of a hearing aid pertaining to a first embodiment.
Figure 2:
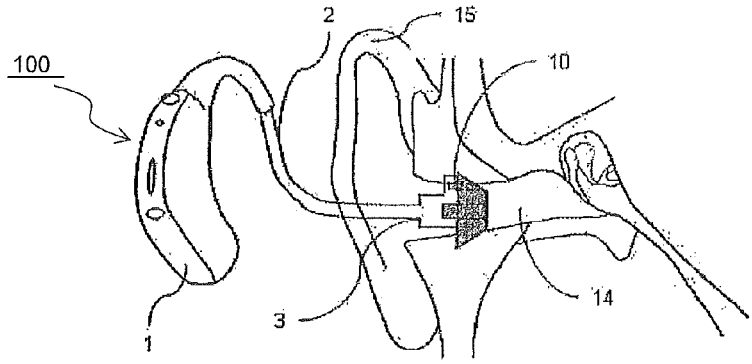
FIG. 2 is a diagram of the state when the hearing aid pertaining to the first embodiment is used.
Figure 3:
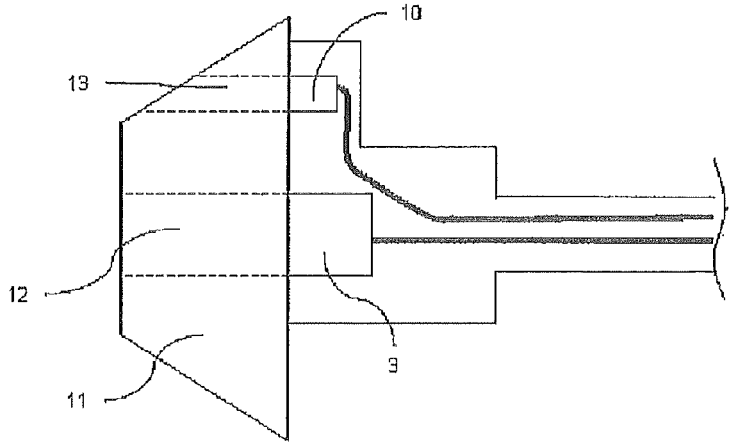
FIG. 3 is a front view of the receiver portion pertaining to the first embodiment.

FIG. 1 shows a hearing aid 100 pertaining to the first embodiment. The hearing aid 100 comprises a main body case 1 that is mounted so as to conform to the rear face side of the ear, and a receiver 3 (an example of a "correction-use sound output component") that is linked to this main body case 1 via an ear hook 2. A control device 4 and a battery 5 are housed inside the main body case 1. A power switch 6, a volume control 7, an external microphone 8, and a mounting correction switch 9 are provided on the surface of the main body case 1. As shown in FIGS. 2 and 3, the receiver 3 is integrated along with an ear canal microphone 10 into a mounting piece 11 formed from a soft material. The receiver 3 and the ear canal microphone 10 respectively open toward the ear canal 14 via acoustic tubes 12 and 13 formed in the mounting piece 11.

In other words, when the receiver 3 is mounted at the inlet to the ear canal 14 as shown in FIG. 2, or inserted into the ear canal 14, the receiver 3 and the ear canal microphone 10 are in a state of being open toward the inside of the ear canal 14 via the acoustic tubes 12 and 13. In FIG. 2, the ear hook 2 is not hooked over the ear (auricle) 15 so as to make it easier to understand the positional relation between the receiver 3 and the ear canal microphone 10 with respect to the ear canal 14. During actual use, however, the receiver 3 is mounted at the inlet to the ear canal 14 as shown in FIG. 2, or is inserted into the ear canal 14, in a state in which the ear hook 2 has been hooked over the ear (auricle) 15 and the main body case 1 has been disposed so as to conform to the rear face of the ear (auricle) 15.

Configuration of Control Device 4

Figure 4:
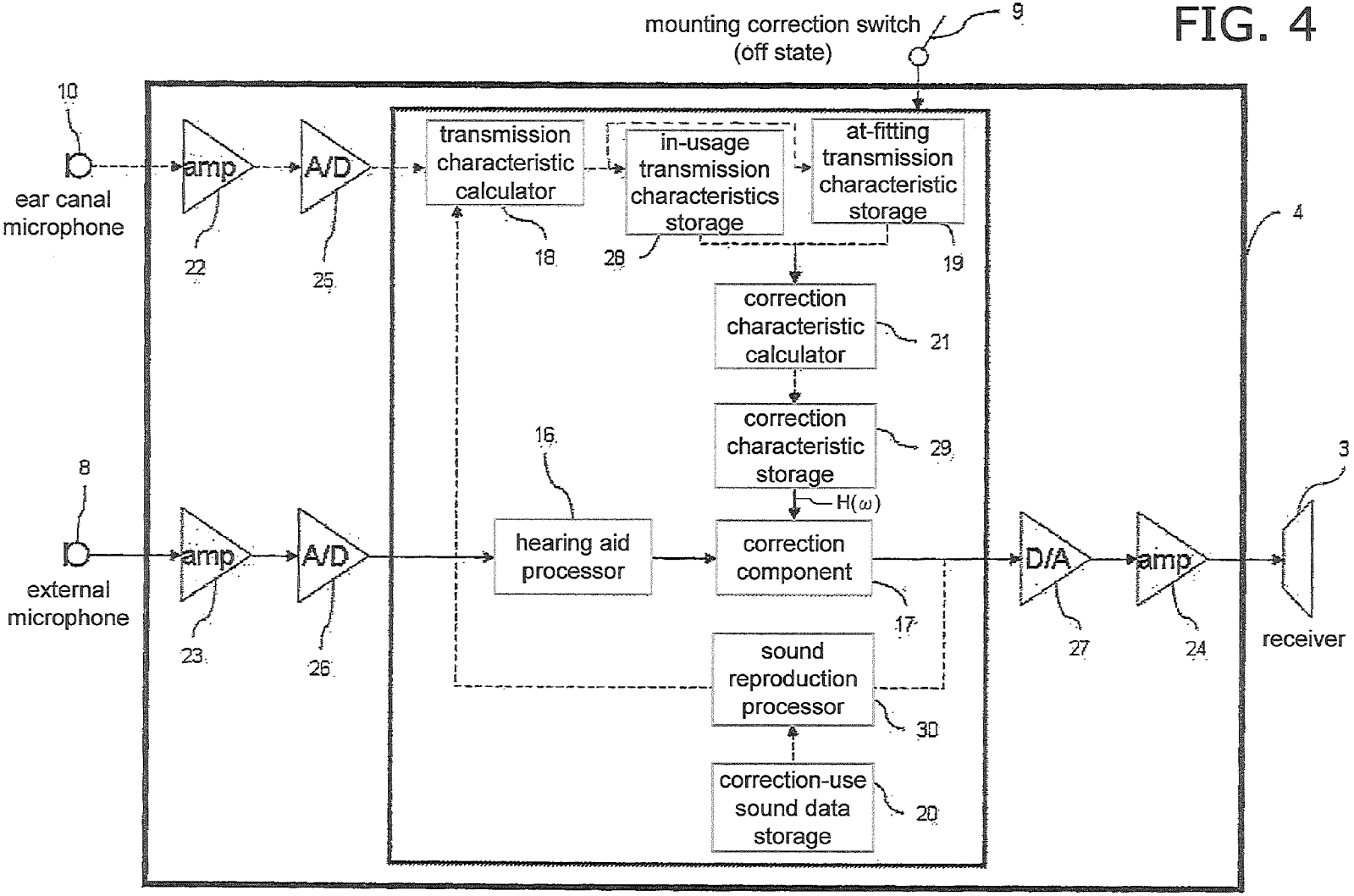
FIG. 4 is a block diagram of the receiver portion pertaining to the first embodiment.
Figure 5:
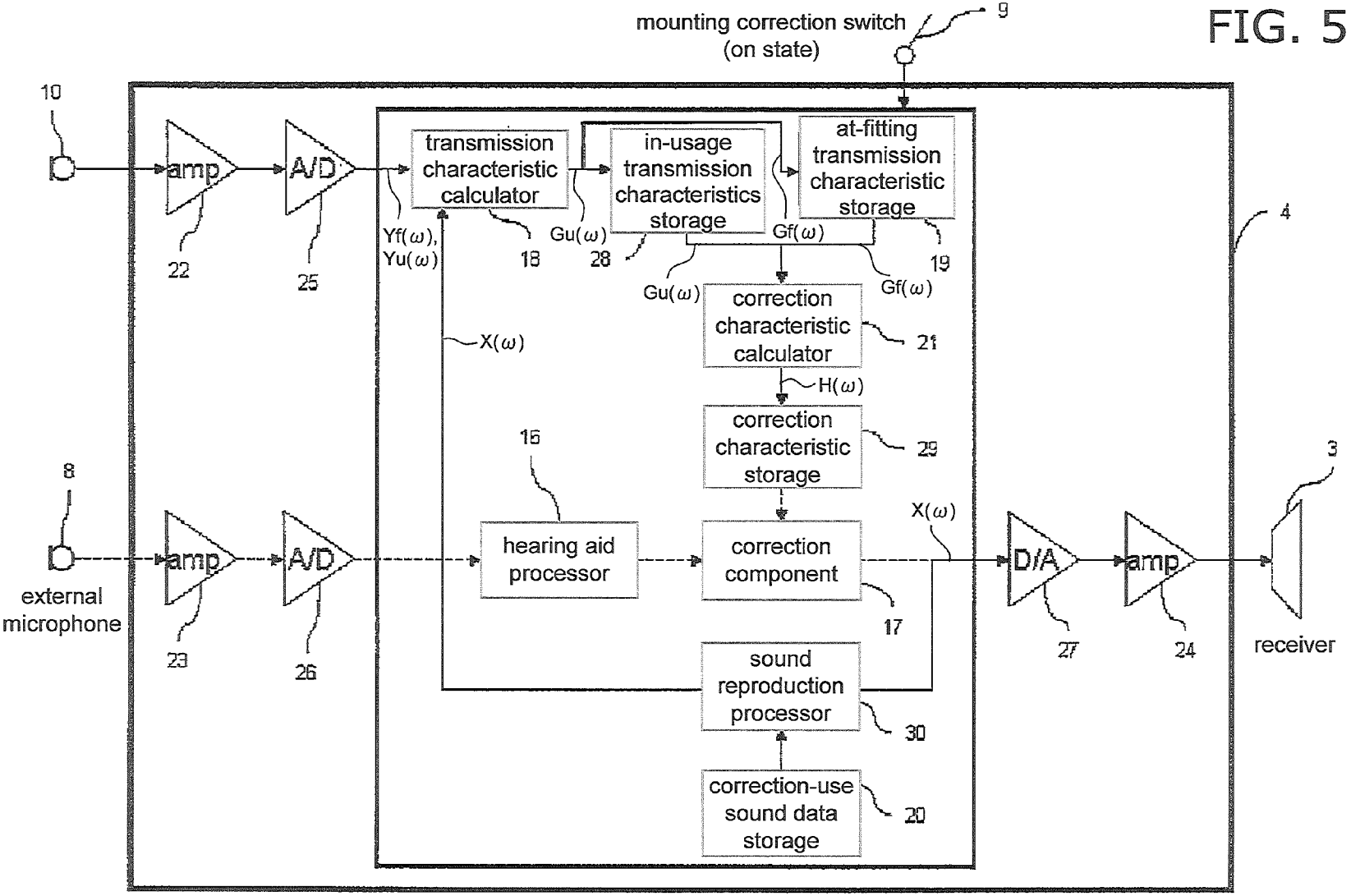
FIG. 5 is a block diagram of the receiver portion pertaining to the first embodiment.

FIGS. 4 and 5 are electrical control block diagrams of the control device 4 pertaining to the first embodiment. In FIGS. 4 and 5, components that are operating are linked by solid lines, and components that are not operating are linked by broken lines.

The control device 4 comprises a hearing aid processor 16 that subjects input sound data indicating the sound collected by the external microphone 8 to hearing aid processing, a correction component 17 that corrects the output of this hearing aid processor 16 and then outputs the result to the receiver 3, a transmission characteristic calculator 18 that is connected to the output side of the ear canal microphone 10, an at-fitting transmission characteristic storage 19, a correction-use sound data storage 20 that outputs the correction-use sound output to the transmission characteristic calculator 18 and the receiver 3, an in-usage transmission characteristic storage 28 that storages the output of the transmission characteristic calculator 18, a correction characteristic calculator 21 that calculates a correction characteristic H (ω) from the output of the at-fitting transmission characteristic storage 19 and the output of the in-usage transmission characteristic storage 28, and a correction characteristic storage 29 provided on the output side of this correction characteristic calculator 21. The mounting correction switch 9 is connected to this control device 4. 22, 23, and 24 are amplifiers, 25 and 26 are A/D converters, 27 is a D/A converter, and 30 is a sound reproduction processor.

Figure 6A:
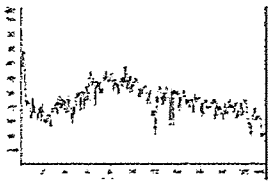
FIG. 6A is a graph of second sound data pertaining to the first embodiment.
Figure 6B:
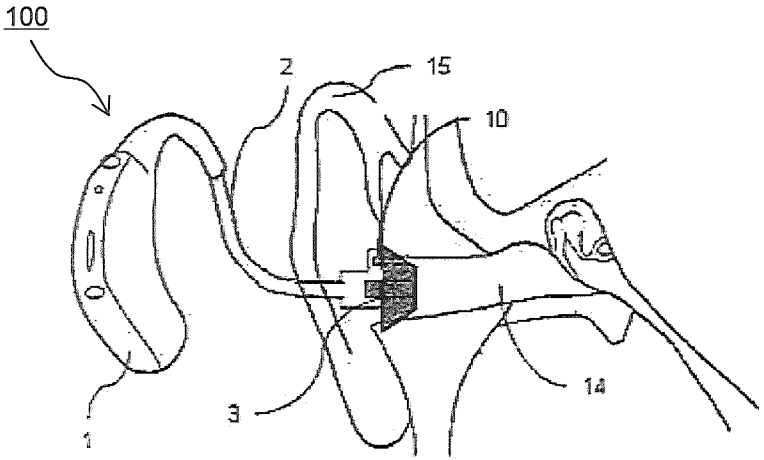
FIG. 6B is a diagram of the state during fitting of the hearing aid pertaining to the first embodiment.
Figure 6C:
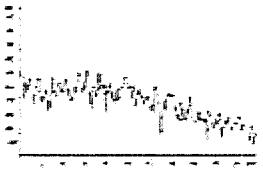
FIG. 6C is a graph of first sound data pertaining to the first embodiment.

FIGS. 6A, 6B, and 6C show the state during the fitting of the hearing aid 100. At this time, the hearing aid is placed on the ear (more specifically, the auricle) 15, and the hearing aid function is set by an ordinary fitting procedure, namely, one in which audible frequency bands are successively outputted from lower sounds to higher sounds to check how well the user can hear those sounds. The fitting information determined by this fitting procedure is registered in the hearing aid processor 16 in FIG. 4. Immediately after this fitting, the mounting correction switch 9 is turned on by the user (see FIG. 5).

The operation of the control device 4 is switched depending on how many times the mounting correction switch 9 is pressed within a specific period of time. If the mounting correction switch 9 is pressed once within the specific period of time, the operation of the control device 4 is switched to an operation in which the at-fitting transmission characteristic is stored in the at-fitting transmission characteristic storage 19. When this happens, the mounting correction switch 9 is switched on, and a voice reports that "The at-fitting transmission characteristic has been stored." Once the at-fitting transmission characteristic has thus been stored, the sound reproduction processor 30 acquires correction-use sound data (an example of "second sound data" pertaining to this embodiment, such as data about sound with low temporal strength over a wide band of 0 to 16 KHz, such as white noise) from the correction-use sound data storage 20. The sound reproduction processor 30 then transmits the correction-use sound data (the spectrum X (ω) shown in FIG. 6A) to the transmission characteristic calculator 18 and outputs to the receiver 3 via the D/A converter 27 and the amplifier 24. As a result, correction-use sound is emitted from the receiver 3, and then the sound from the receiver 3 is collected by the ear canal microphone 10.

As shown in FIG. 5, the first sound data (the spectrum Yf (ω) shown in FIG. 6C) produced when the correction-use sound is collected by the ear canal microphone 10 is supplied to the transmission characteristic calculator 18. The transmission characteristic calculator 18 compares the first sound data (the spectrum Yf (ω) shown in FIG. 6C) produced by sound collection by the ear canal microphone 10, with the correction-use sound data (an example of second sound data, the spectrum X (ω) shown in FIG. 6A), and calculates the at-fitting transmission characteristic Gf (ω) on the basis of this comparison result. The transmission characteristic calculator 18 stores the at-fitting transmission characteristic Gf (ω) in the at-fitting transmission characteristic storage 19. The method for calculating the at-fitting transmission characteristic Gf (ω) will be discussed below.

Next, when the mounting correction switch 9 is pressed three times within the specific period of time, the mounting correction switch 9 is switched off as in FIG. 4 (it is reported by voice from the receiver 3 that the mounting correction switch 9 has been switched off), and the hearing aid is used in that state for that day. That is, only the external microphone 8, the amplifiers 23 and 24, the A/D converter 26, the D/A converter 27, the hearing aid processor 16, the correction component 17, and the receiver 3 operate, and ordinary hearing aid operation is carried out, specifically, the hearing aid operation related to the fitting information registered to the hearing aid processor 16. At this point, since no output from the correction characteristic calculator 21 is supplied to the correction characteristic storage 29, the correction component 17 does not perform a correction operation, and the signal is merely passed through.

Figure 7A:
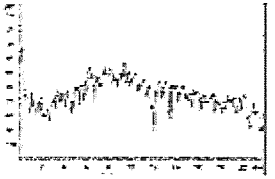
FIG. 7A is a graph of fourth sound data pertaining to the first embodiment.
Figure 7B:
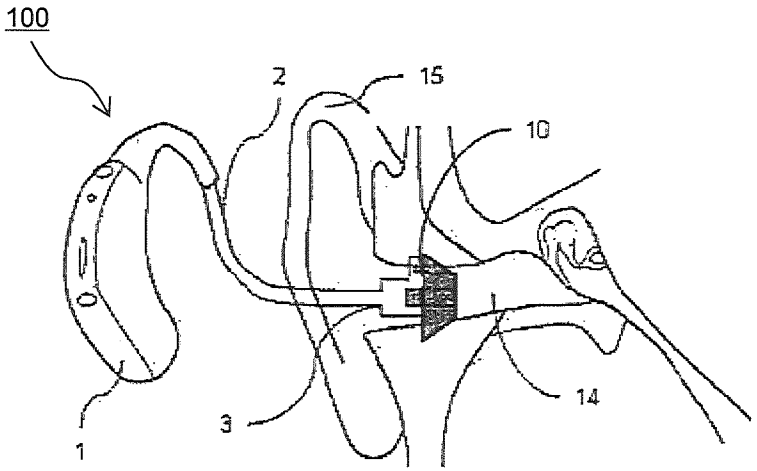
FIG. 7B is a diagram of the state when the hearing aid pertaining to the first embodiment is used.
Figure 7C:
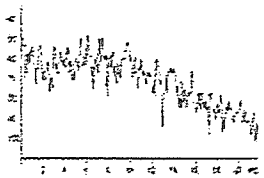
FIG. 7C is a graph of third sound data pertaining to the first embodiment.

FIGS. 7A, 7B, and 7C show a state in which the user has put on the hearing aid 100 the next day, and as is clear from a comparison of FIGS. 6B and 7B, the mounting position of the receiver 3 has shifted deeper into the ear canal 14. At this point the volume inside the ear canal is smaller than that in FIG. 6B (conversely, the volume inside the ear canal increases if the receiver 3 is inserted more shallowly into the ear canal 14). This fluctuation in the volume inside the ear canal directly affects acoustic characteristics (frequency characteristics). As a result, the user experiences the discomfort of having hearing that is quite different from that during the fitting on the previous day, so the user feels less satisfied with his hearing.

If the user presses the mounting correction switch 9 twice within the specific period of time, the mounting correction switch 9 is switched on as in FIG. 5 (it is reported by voice from the receiver 3 that the mounting correction switch 9 has been switched on and correction processing is being executed). When this happens, the sound reproduction processor 30 acquires correction-use sound data (such as data about sound with low temporal strength over a wide band of 0 to 16 KHz, such as white noise) from the correction-use sound data storage 20. The sound reproduction processor 30 then transmits the correction-use sound data (an example of the "fourth sound data" pertaining to this embodiment, the spectrum X (ω) shown in FIG. 7A) to the transmission characteristic calculator 18 and outputs to the receiver 3 via the D/A converter 27 and the amplifier 24.

As a result, correction-use sound is emitted from the receiver 3, and this correction-use sound is collected by the ear canal microphone 10. Third sound data (the spectrum Yu (ω) shown in FIG. 7C) produced by sound collection by the ear canal microphone 10 is supplied to the transmission characteristic calculator 18. The transmission characteristic calculator 18 compares the third sound data (the spectrum Yu (ω) shown in FIG. 7C) produced by sound collection by the ear canal microphone 10, with the correction-use sound data transmitted from the sound reproduction processor 30 (an example of the "fourth sound data" pertaining to this embodiment, the spectrum X (ω) shown in FIG. 7A), and calculates the in-usage transmission characteristic Gu (ω) on the basis of this comparison result. The transmission characteristic calculator 18 stores the in-usage transmission characteristic Gu (ω) thus calculated in the in-usage transmission characteristic storage 28. The method for calculating the in-usage transmission characteristic Gu (ω) will be discussed below.

After this, the correction characteristic calculator 21 calculates a correction characteristic H (ω) from the in-usage transmission characteristic Gu (ω) stored in the in-usage transmission characteristic storage 28 and the at-fitting transmission characteristic Gf (ω) stored in the at-fitting transmission characteristic storage 19, and stores this correction characteristic H (ω) in the correction characteristic storage 29. The method for calculating the correction characteristic H (ω) will be discussed below.

Next, when the mounting correction switch 9 is pressed three times within the specific period of time, the mounting correction switch 9 is switched off as in FIG. 4 (it is reported by voice from the receiver 3 that the mounting correction switch 9 has been switched off). At this point, as shown by the solid lines in FIG. 4, the external microphone 8, the amplifiers 23 and 24, the A/D converters 26 and 27, the hearing aid processor 16, the correction component 17, and the receiver 3 operate, and the correction component 17 corrects the input sound data that has undergone hearing aid processing by the hearing aid processor 16, on the basis of the correction characteristic H (ω) stored in the correction characteristic storage 29.

Method for Calculating At-Fitting Transmission Characteristic Gf (ω)

Figure 8:
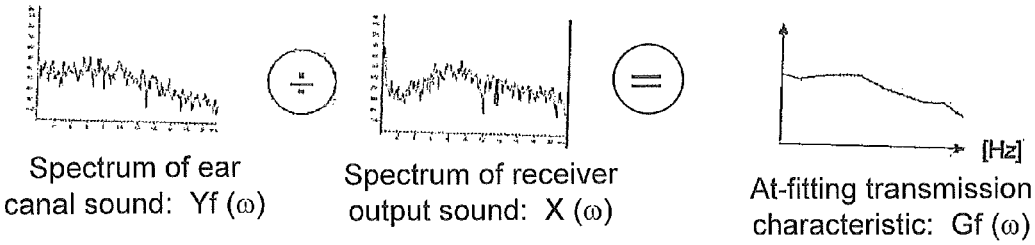
FIG. 8 is a schematic diagram of the method for calculating an at-fitting transmission characteristic pertaining to the first embodiment.

FIG. 8 is a schematic diagram illustrating the method for calculating the at-fitting transmission characteristic Gf (ω) by the transmission characteristic calculator 18. The at-fitting transmission characteristic Gf (ω) is calculated by dividing the first sound data (the spectrum Yf (ω) shown in FIG. 6C) produced when the ear canal microphone 10 collects the correction-use sound outputted from the receiver 3 during fitting, by the correction-use sound data from the correction-use sound data storage 20 (an example of the "second sound data" pertaining to this embodiment, the spectrum X (ω) shown in FIG. 6A). The at-fitting transmission characteristic Gf (ω) here is calculated, for example, on the basis of the following Calculation Formula 1 or 2.

$$Gf(\omega)=Yf(\omega)/X(\omega) \tag{1}$$

$$Gf(\omega)=[\Sigma\{Yf(\omega)/X(\omega)\}]/N \tag{2}$$

Method for Calculating In-Usage Transmission Characteristic Gu (ω)

Figure 9:
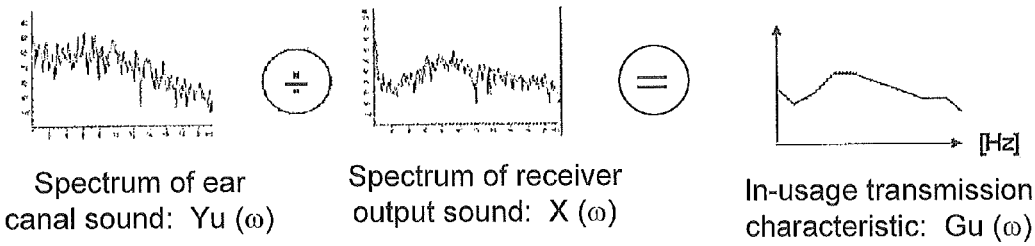
FIG. 9 is a schematic diagram of the method for calculating an in-usage transmission characteristic pertaining to the first embodiment.

FIG. 9 is a schematic diagram illustrating the method for calculating the in-usage transmission characteristic Gu (ω)

by the transmission characteristic calculator 18. The in-usage transmission characteristic Gu (ω) is calculated by dividing the third sound data (the spectrum Yu (ω) shown in FIG. 7C) produced when the ear canal microphone 10 collects the correction-use sound outputted from the receiver 3 when the user presses the mounting correction switch 9 twice within the specific period of time, by the correction-use sound data from the correction-use sound data storage 20 (an example of the "fourth sound data" pertaining to this embodiment, the spectrum X (ω) shown in FIG. 7A). The in-usage transmission characteristic Gu (ω) here is calculated, for example, on the basis of the following Calculation Formula 3 or 4.

$$Gu(\omega)=Yu(\omega)/X(\omega) \quad (3)$$

$$Gu(\omega)=[\Sigma\{Yu(\omega)/X(\omega)\}]/N \quad (4)$$

Method for Calculating Correction Characteristic H (ω)

Figure 10:
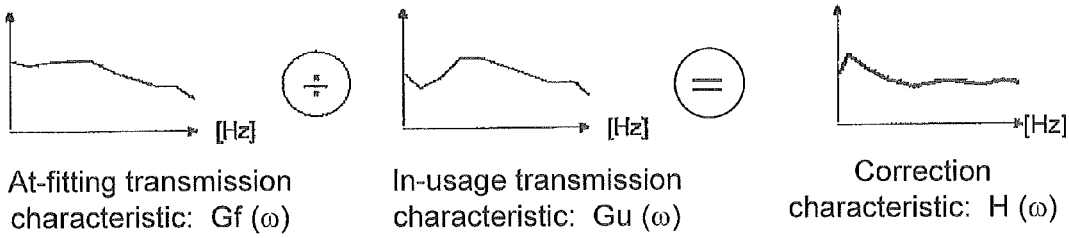
FIG. 10 is a schematic diagram of the method for calculating a correction characteristic pertaining to the first embodiment.

FIG. 10 is a schematic diagram illustrating the method for calculating the correction characteristic H (ω) by the correction characteristic calculator 21. The correction characteristic H (ω) is calculated by dividing the at-fitting transmission characteristic Gf (ω) in FIG. 8 by the in-usage transmission characteristic Gu (ω) in FIG. 9. This correction characteristic H (ω) is calculated, for example, on the basis of the following Calculation Formula 5, etc.

$$H(\omega)=Gf(\omega)/Gu(\omega) \quad (5)$$

The correction characteristic H (ω) in FIG. 10 obtained in this manner is stored in the correction characteristic storage 29, and the correction characteristic H (ω) stored in the correction characteristic storage 29 is supplied to the correction component 17. The correction component 17 then corrects the output from the hearing aid processor 16 on the basis of the correction characteristic H (ω).

Action and Effect

With the hearing aid 100 pertaining to the first embodiment, the control device 4 comprises the transmission characteristic calculator 18, the correction characteristic calculator 21, and the correction component 17. The transmission characteristic calculator 18 calculates the at-fitting transmission characteristic Gf (ω) on the basis of the first sound data (the spectrum Yf (ω) shown in FIG. 6C) produced when the ear canal microphone 10 collects the correction-use sound outputted from the receiver 3 (an example of a correction-use sound output component) during fitting, and the correction-use sound data (an example of the "second sound data" pertaining to this embodiment, the spectrum X (ω) shown in FIG. 6A). The transmission characteristic calculator 18 calculates the correction characteristic G (ω) on the basis of the third sound data (the spectrum Yu (ω) shown in FIG. 7C) produced when the ear canal microphone 10 collects the correction-use sound outputted from the receiver 3 according to a user operation after fitting, and the correction-use sound data (an example of the "fourth sound data" pertaining to this embodiment, the spectrum X (ω) shown in FIG. 7A). The correction characteristic calculator 21 calculates the correction characteristic H (ω) on the basis of the at-fitting transmission characteristic Gf (ω) and the in-usage transmission characteristic Gu (ω). The correction component 17 corrects the input sound data that has undergone hearing aid processing by the hearing aid processor 16, on the basis of the correction characteristic H (ω).

Thus, the correction component 17 corrects the input sound data that has undergone hearing aid processing, on the basis of the correction characteristic H (ω), which was calculated on the basis of the in-usage transmission characteristic Gu (ω) calculated according to a user request and the at-fitting transmission characteristic Gf (ω) already acquired at the time of fitting. Therefore, even if the volume inside the ear canal should fluctuate due to minute deviation in the mounting position of the hearing aid 100 from that during fitting, the input sound data that has undergone hearing aid processing will be corrected according to this fluctuation in the volume inside the ear canal. Accordingly, there will be less fluctuation in the acoustic characteristics (frequency characteristics) accompanying deviation in the mounting position of the hearing aid 100, so the user can be more satisfied with his hearing.

Second Embodiment

Configuration of Hearing Aid 100A

Figure 11:
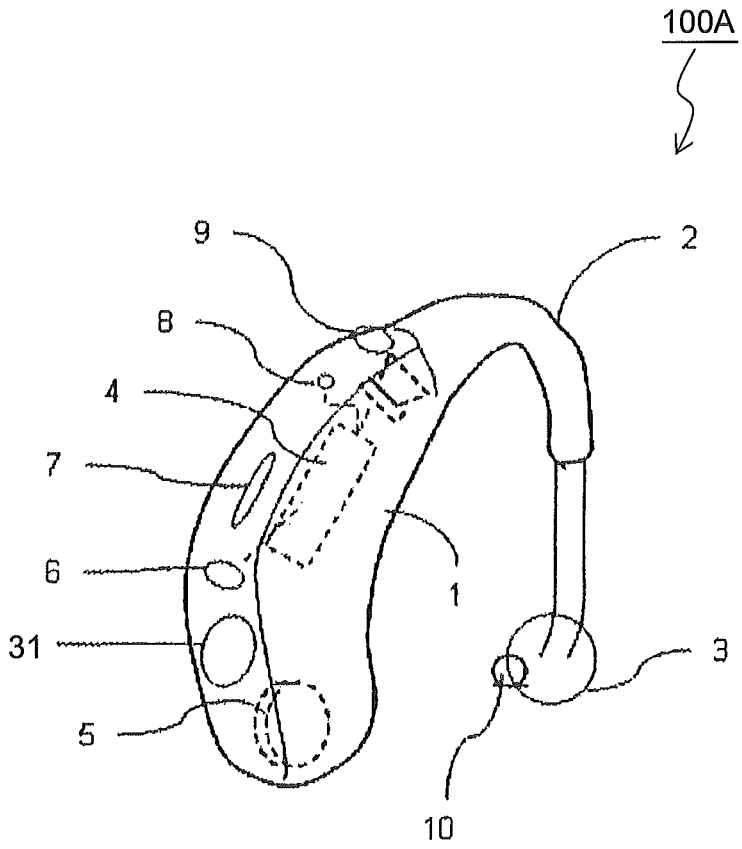
FIG. 11 is an oblique view of a hearing aid pertaining to a second embodiment.

FIG. 11 shows a hearing aid 100A pertaining to the second embodiment. As shown in FIG. 11, the hearing aid 100A differs from the hearing aid 100 pertaining to the first embodiment above in that it comprises a correction sound-use speaker 31 (an example of a "correction-use sound output component") provided to the surface of the main body case 1.

Control Device 4A

Figure 12:
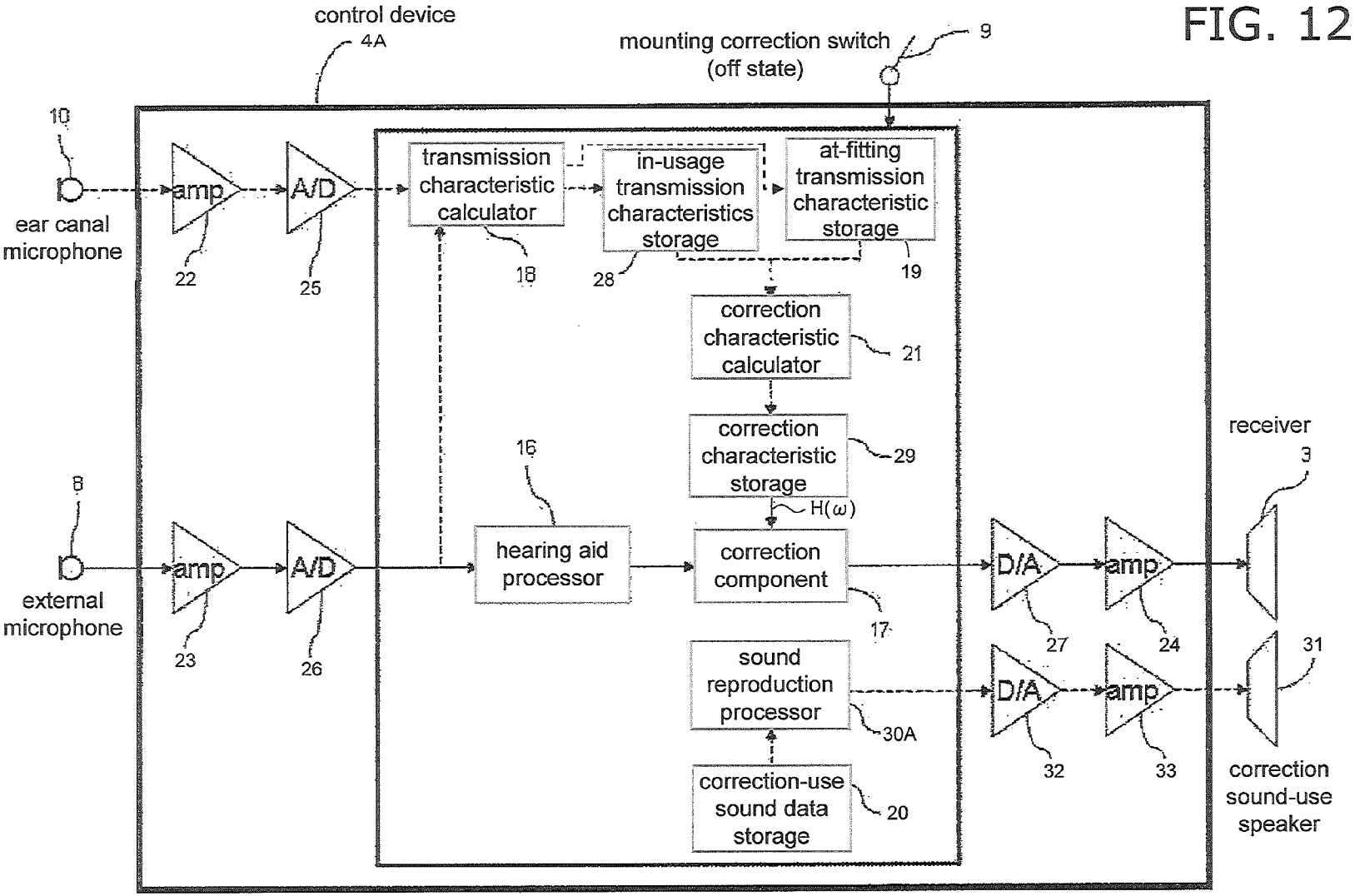
FIG. 12 is a control block diagram pertaining to the second embodiment.
Figure 13:
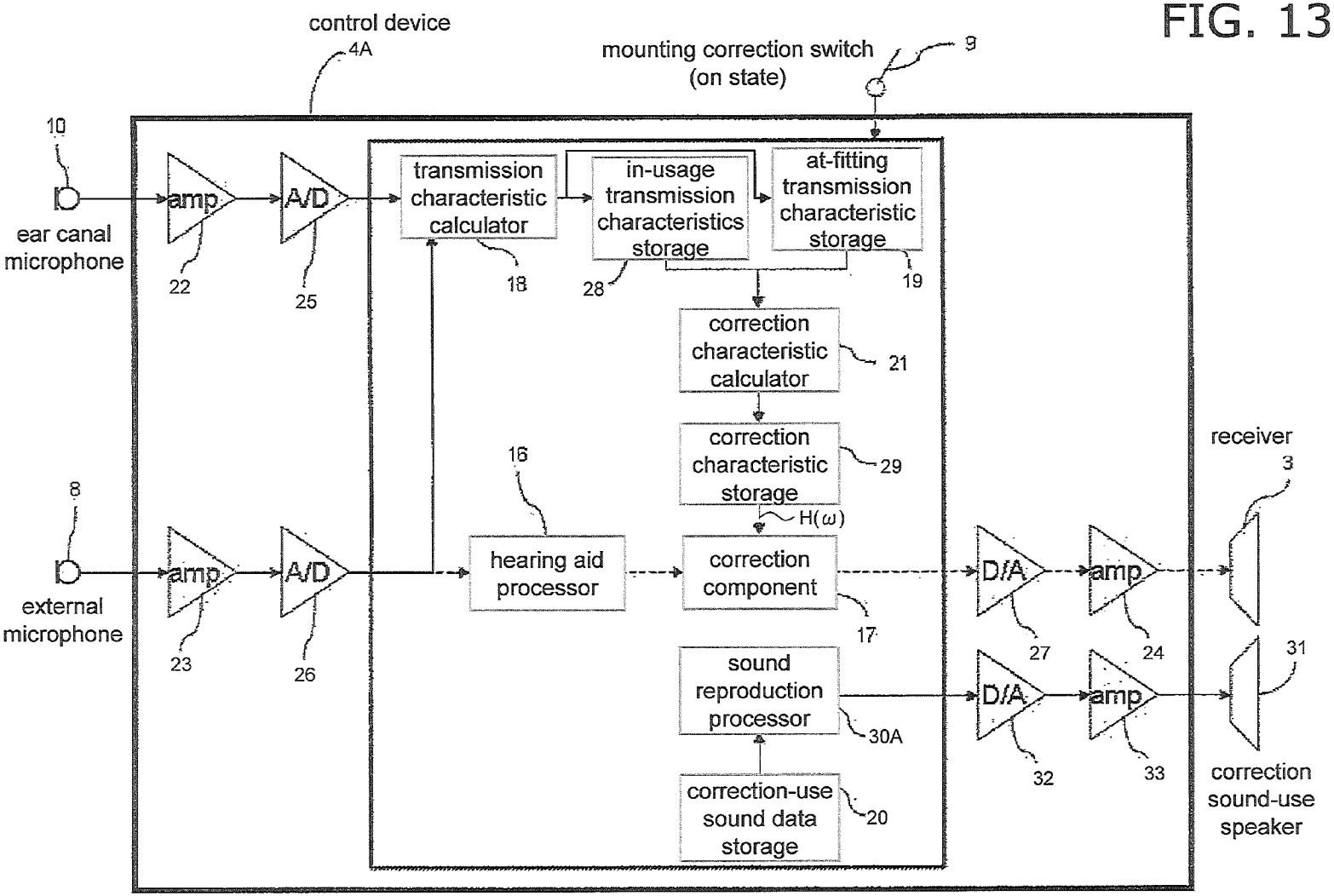
FIG. 13 is a control block diagram pertaining to the second embodiment.

FIGS. 12 and 13 are electrical control block diagrams for the control device 4A pertaining to the second embodiment. In FIGS. 12 and 13, components that are operating are linked by solid lines, and components that are not operating are linked by broken lines.

The control device 4A differs from the control device 4 pertaining to the first embodiment above in that a sound reproduction processor 30A is connected to the correction sound-use speaker 31. The sound reproduction processor 30A is connected to the correction sound-use speaker 31 via a D/A converter 32 and an amplifier 33.

Figure 14A:
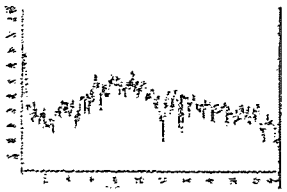
FIG. 14A is a graph of the second sound data pertaining to the second embodiment.
Figure 14B:
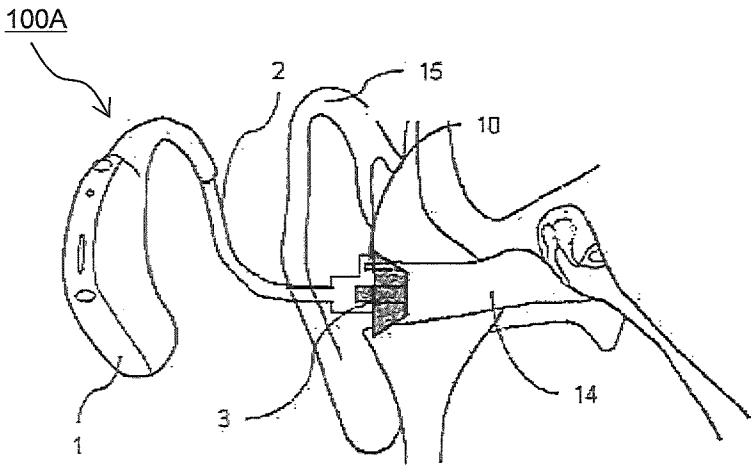
FIG. 14B is a diagram of the state during the fitting of the hearing aid pertaining to the second embodiment.
Figure 14C:
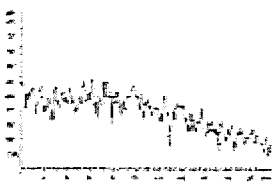
FIG. 14C is a graph of the first sound data pertaining to the second embodiment.

FIGS. 14A, 14B, and 14C show the state of the hearing aid 100A during fitting. At this point, the hearing aid is placed on the ear (more specifically, the auricle) 15, and the hearing aid function is set by an ordinary fitting procedure, namely, one in which audible frequency bands are successively outputted from lower sounds to higher sounds to check how well the user can hear those sounds. The fitting information determined by this fitting procedure is registered in the hearing aid processor 16 in FIG. 12. Immediately after this fitting, the mounting correction switch 9 is turned on by the user (see FIG. 13).

The operation of the control device 4A is switched depending on how many times the mounting correction switch 9 is pressed within the specific period of time. If the mounting correction switch 9 is pressed once within the specific period of time, the operation of the control device 4A is switched to an operation in which the at-fitting transmission characteristic is stored in the at-fitting transmission characteristic storage 19. When this happens, the mounting correction switch 9 is switched on, and a voice reports that "The at-fitting transmission characteristic has been stored." Once the at-fitting transmission characteristic has thus been stored, the sound reproduction processor 30A acquires correction-use sound data (such as data about sound with low temporal strength over a wide band of 0 to 16 KHz, such as white noise) from the correction-use sound data storage 20. The sound reproduction processor 30A then outputs the correction-use sound data to the correction sound-use speaker 31 via the D/A converter 32 and the amplifier 33. As a result, correction-use sound is emitted from the correction sound-use speaker 31, and then the sound from the correction sound-use speaker 31 is collected by the external microphone 8 and the ear canal microphone 10.

As shown in FIG. 13, the first sound data (the spectrum Yf (ω) shown in FIG. 14C) produced when the correction-use sound is collected by the ear canal microphone 10, and the second sound data produced when the correction-use sound is collected by the external microphone 8 (an example of the "second sound data" pertaining to this embodiment, the spectrum X (ω) shown in FIG. 14A) is supplied to the transmission characteristic calculator 18.

The transmission characteristic calculator 18 compares the first sound data (the spectrum Yf (ω) shown in FIG. 14C) with the second sound data (the spectrum X (ω) shown in FIG. 14A), and calculates the at-fitting transmission characteristic Gf (ω) on the basis of this comparison result. The transmission characteristic calculator 18 stores the at-fitting transmission characteristic Gf (ω) in the at-fitting transmission characteristic storage 19. The method for calculating the at-fitting transmission characteristic Gf (ω) will be discussed below.

When the at-fitting transmission characteristic Gf (ω) is calculated, the transmission characteristic calculator 18 is selectively connected not to the in-usage transmission characteristics storage 28 (discussed below), but to the at-fitting transmission characteristic storage 19.

In the first embodiment above, the correction-use sound data itself was used as an example of the "second sound data," but in the second embodiment, an example will be described in which the "second sound data" is data indicating correction-use sound collected by the external microphone 8 during fitting.

Next, when the mounting correction switch 9 is pressed three times within the specific period of time, the mounting correction switch 9 is switched off as in FIG. 13 (it is reported by voice from the receiver 3 that the mounting correction switch 9 has been switched off), and the hearing aid is used in that state for that day. That is, only the external microphone 8, the amplifiers 23 and 24, the A/D converter 26, the D/A converter 27, the hearing aid processor 16, the correction component 17, and the receiver 3 operate, and ordinary hearing aid operation is carried out, specifically, the hearing aid operation related to the fitting information registered to the hearing aid processor 16. At this point, since no output from the correction characteristic calculator 21 is supplied to the correction characteristic storage 29, the correction component 17 does not perform a correction operation, and the signal is merely passed through.

Figure 15A:
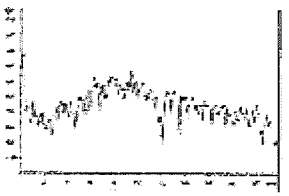
FIG. 15A is a graph of the fourth sound data pertaining to the second embodiment.
Figure 15B:
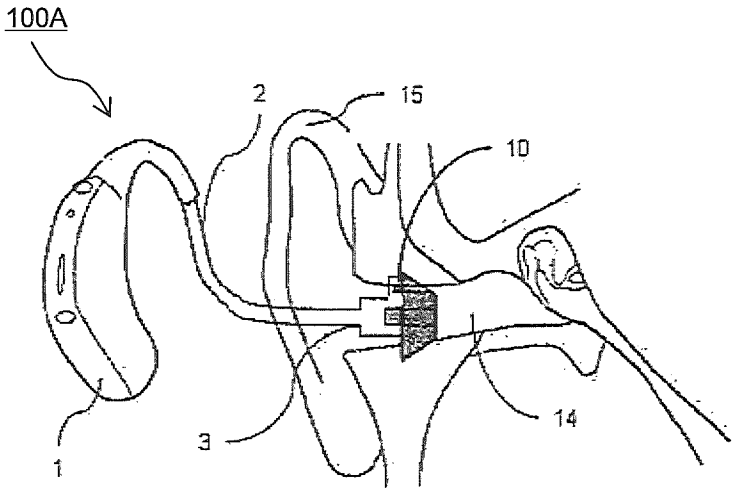
FIG. 15B is a diagram of the state when the hearing aid pertaining to the second embodiment is used.
Figure 15C:
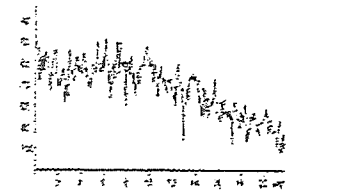
FIG. 15C is a graph of the third sound data pertaining to the second embodiment.

FIGS. 15A, 15B, and 15C show a state in which the user has put on the hearing aid 100A the next day, and as is clear from a comparison of FIGS. 14B and 15B, the mounting position of the receiver 3 has shifted deeper into the ear canal 14. At this point the volume inside the ear canal is smaller than that in FIG. 14B (conversely, the volume inside the ear canal increases if the receiver 3 is inserted more shallowly into the ear canal 14). This fluctuation in the volume inside the ear canal directly affects acoustic characteristics (frequency characteristics). As a result, the user experiences the discomfort of having hearing that is quite different from that during the fitting on the previous day, so the user feels less satisfied with his hearing.

If the user presses the mounting correction switch 9 twice within the specific period of time, the mounting correction switch 9 is switched on as in FIG. 13 (it is reported by voice from the receiver 3 that the mounting correction switch 9 has been switched on and correction processing is being executed). When this happens, the sound reproduction processor 30A acquires correction-use sound data (such as data about sound with low temporal strength over a wide band of 0 to 16 KHz, such as white noise) from the correction-use sound data storage 20. The sound reproduction processor 30A then outputs the correction-use sound data to the correction sound-use speaker 31 via the D/A converter 27 and the amplifier 24.

As a result, correction-use sound is emitted from the correction sound-use speaker 31, and this correction-use sound is collected by the ear canal microphone 10 and the external microphone 8. Third sound data (the spectrum Yu (ω) shown in FIG. 15C) produced by sound collection by the ear canal microphone 10, and fourth sound data (the spectrum X (ω) shown in FIG. 15A) produced by sound collection by the external microphone 8 are supplied to the transmission characteristic calculator 18. The transmission characteristic calculator 18 compares the third sound data (the spectrum Yu (ω) shown in FIG. 15C) with the fourth sound data (the spectrum X (ω) shown in FIG. 15A), and calculates the in-usage transmission characteristic Gu (ω) on the basis of this comparison result. The transmission characteristic calculator 18 stores the in-usage transmission characteristic Gu (ω) thus calculated in the in-usage transmission characteristic storage 28. The method for calculating the in-usage transmission characteristic Gu (ω) will be discussed below.

When the in-usage transmission characteristic Gu (ω) is calculated, the transmission characteristic calculator 18 is selectively connected not to the at-fitting transmission characteristic storage 19, but to the in-usage transmission characteristics storage 28.

In the first embodiment above, the correction-use sound data itself was used as an example of the "fourth sound data," but in the second embodiment, an example will be described in which the correction sound-use speaker 31 outputs according to user operation, and the "fourth sound data" is data indicating correction-use sound collected by the external microphone 8.

After this, the correction characteristic calculator 21 calculates a correction characteristic H (ω) from the in-usage transmission characteristic Gu (ω) stored in the in-usage transmission characteristic storage 28 and the at-fitting transmission characteristic Gf (ω) stored in the at-fitting transmission characteristic storage 19, and stores this correction characteristic H (ω) in the correction characteristic storage 29. The method for calculating the correction characteristic H (ω) will be discussed below.

Next, when the mounting correction switch 9 is pressed three times within the specific period of time, the mounting correction switch 9 is switched off as in FIG. 12 (it is reported by voice from the receiver 3 that the mounting correction switch 9 has been switched off). At this point, as shown by the solid lines in FIG. 12, the external microphone 8, the amplifiers 23 and 24, the A/D converters 26 and 27, the hearing aid processor 16, the correction component 17, and the receiver 3 operate, and the correction component 17 corrects the input sound data that has undergone hearing aid processing by the hearing aid processor 16, on the basis of the correction characteristic H (ω) stored in the correction characteristic storage 29.

Method for Calculating At-Fitting Transmission Characteristic Gf (ω)

Figure 16:
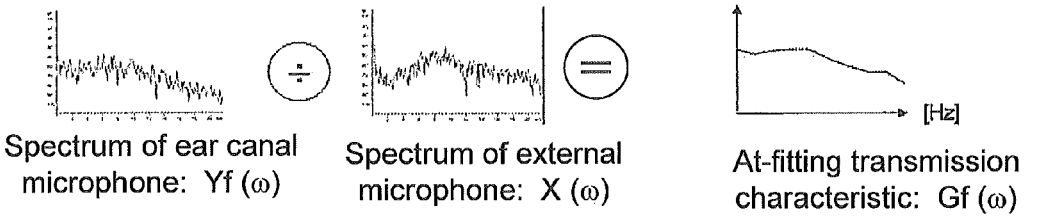
FIG. 16 is a schematic diagram of the method for calculating an at-fitting transmission characteristic pertaining to the second embodiment.

FIG. 16 is a schematic diagram illustrating the method for calculating the at-fitting transmission characteristic Gf (ω) by the transmission characteristic calculator 18. The at-fitting transmission characteristic Gf (ω) is calculated by dividing the first sound data (the spectrum Yf (ω) shown in FIG. 14C) produced when the ear canal microphone 10 collects the correction-use sound outputted from the correction sound-use speaker 31 during fitting, by the second sound data (the spectrum X (ω) shown in FIG. 14A) produced when correction-use sound is collected by the external microphone 8. The at-fitting transmission characteristic Gf (ω) here is calculated, for example, on the basis of the following Calculation Formula 6 or 7.

$$Gf(\omega)=Yf(\omega)/X(\omega) \quad (6)$$

$$Gf(\omega)=[\Sigma\{Yf(\omega)/X(\omega)\}]/N \quad (7)$$

Method for Calculating In-Usage Transmission Characteristic Gu (ω)

Figure 17:
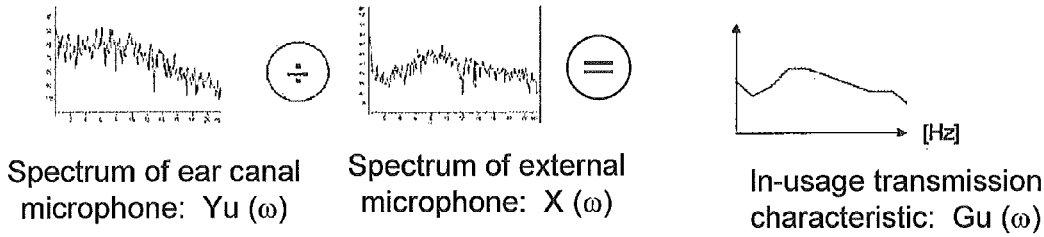
FIG. 17 is a schematic diagram of the method for calculating an in-usage transmission characteristic pertaining to the second embodiment.

FIG. 17 is a schematic diagram illustrating the method for calculating the in-usage transmission characteristic Gu (ω) by the transmission characteristic calculator 18. The in-usage transmission characteristic Gu (ω) is calculated by dividing the third sound data (the spectrum Yu (ω) shown in FIG. 15C) produced when the ear canal microphone 10 collects the correction-use sound outputted from the receiver 3 when the user presses the mounting correction switch 9 twice within the specific period of time, by the fourth sound data (the spectrum X (ω) shown in FIG. 15A) produced when the correction-use sound is collected by the external microphone 8. The in-usage transmission characteristic Gu (ω) here is calculated, for example, on the basis of the following Calculation Formula 8 or 9.

$$Gu(\omega)=Yu(\omega)/X(\omega) \quad (8)$$

$$Gu(\omega)=[\Sigma\{Yu(\omega)/X(\omega)\}]/N \quad (9)$$

Method for Calculating Correction Characteristic H (ω)

Figure 18:
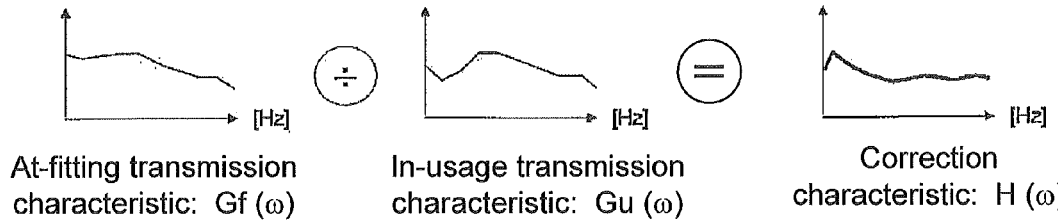
FIG. 18 is a schematic diagram of the method for calculating a correction characteristic pertaining to the second embodiment.

FIG. 18 is a schematic diagram illustrating the method for calculating the correction characteristic H (ω) by the correction characteristic calculator 21. The correction characteristic H (ω) is calculated by dividing the at-fitting transmission characteristic Gf (ω) in FIG. 16 by the in-usage transmission characteristic Gu (ω) in FIG. 17. This correction characteristic H (ω) is calculated, for example, on the basis of the following Calculation Formula 10, etc.

$$H(\omega)=Gf(\omega)/Gu(\omega) \quad (10)$$

The correction characteristic H (ω) in FIG. 18 obtained in this manner is stored in the correction characteristic storage 29, and the correction characteristic H (ω) stored in the correction characteristic storage 29 is supplied to the correction component 17. The correction component 17 then corrects the output from the hearing aid processor 16 on the basis of the correction characteristic H (ω).

Action and Effect

With the hearing aid 100A pertaining to the second embodiment, the control device 4A comprises the transmission characteristic calculator 18, the correction characteristic calculator 21, and the correction component 17. The transmission characteristic calculator 18 calculates the at-fitting transmission characteristic Gf (ω) on the basis of the first sound data (the spectrum Yf (ω) shown in FIG. 14C) produced when the ear canal microphone 10 collects the correction-use sound outputted from the correction sound-use speaker 31 (an example of a "correction-use sound output component") during fitting, and the second sound data (the spectrum X (ω) shown in FIG. 14A) produced by collection by the external microphone 8. The transmission characteristic calculator 18 calculates the in-usage transmission characteristic Gu (ω) on the basis of third sound data produced when the ear canal microphone 10 collects the correction-use sound outputted from the correction sound-use speaker 31 according to user operation after fitting, and fourth sound data (the spectrum X (ω) shown in FIG. 15A) produced by collection by the external microphone 8. The correction characteristic calculator 21 calculates the correction characteristic H (ω) on the basis of the at-fitting transmission characteristic Gf (ω) and the in-usage transmission characteristic Gu (ω). The correction component 17 corrects the input sound data that has undergone hearing aid processing by the hearing aid processor 16, on the basis of the correction characteristic H (ω).

Thus, the correction component 17 corrects the input sound data that has undergone hearing aid processing, on the basis of the correction characteristic H (ω), which was calculated on the basis of the in-usage transmission characteristic Gu (ω) calculated according to a user request and the at-fitting transmission characteristic Gf (ω) already acquired at the time of fitting. Therefore, even if the volume inside the ear canal should fluctuate due to minute deviation in the mounting position of the hearing aid 100A from that during fitting, the input sound data that has undergone hearing aid processing will be corrected according to this fluctuation in the volume inside the ear canal. Accordingly, there will be less fluctuation in the acoustic characteristics (frequency characteristics) accompanying deviation in the mounting position of the hearing aid 100A, so the user can be more satisfied with his hearing.

Other Embodiments (A) In the above embodiments, the correction characteristic calculator 21 calculated the correction characteristic H (ω) from the in-usage transmission characteristic Gu (ω) stored in the in-usage transmission characteristics storage 28 and the at-fitting transmission characteristic Gf (ω) stored in the correction-use sound data storage 20. However, since the in-usage transmission characteristic Gu (ω) is outputted from the transmission characteristic calculator 18, the correction characteristic H (ω) may be calculated from the output of the transmission characteristic calculator 18 as the in-usage transmission characteristic Gu (ω) and the at-fitting transmission characteristic stored in the at-fitting transmission characteristic storage 19.

Figure 19:
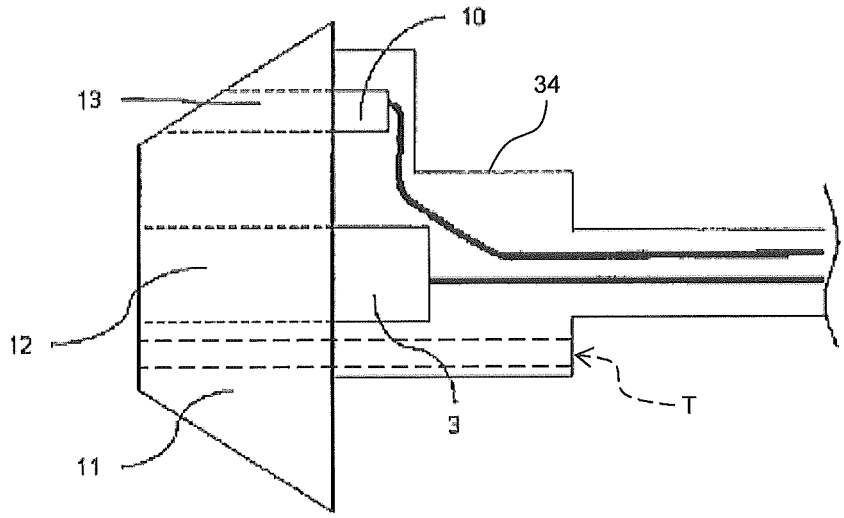
FIG. 19 is a front view of the configuration of a through-hole T pertaining to an embodiment.

(B) Although not specifically mentioned in the second embodiment above, as shown in FIG. 19, the hearing aid 100 may comprise an ear plug 34 in which the receiver 3 and the ear canal microphone 10 are embedded, and a through-hole T that is formed in the ear plug 34 and communicates between the inside of the ear canal 14 and the outside of the ear canal 14. In this case, the correction-use sound emitted from the correction sound-use speaker 31 is guided through the through-hole T into the ear canal 14. Therefore, the correction-use sound emitted from the correction sound-use speaker 31 can be accurately reflected in the first sound data (the spectrum Yf (ω) shown in FIG. 14C) and the third sound data (the spectrum Yu (ω) shown in FIG. 15C). Furthermore, providing the through-hole T reduces the sensation of sound being trapped inside the ear canal 14, and therefore further improves the user's hearing.

(C) In the second embodiment above, the second sound data (the spectrum X (ω) shown in FIG. 14A) and the fourth sound data (the spectrum X (ω) shown in FIG. 15A) were produced by collection of sound at the external microphone 8, but this is not the only option. The correction-use sound data stored in the correction-use sound data storage 20 can be used as the second sound data and/or the fourth sound data.

INDUSTRIAL APPLICABILITY

With the present invention, after the user puts the hearing aid on an ear, if the user operates a mounting correction switch upon sensing something unsatisfactory, the feeling that there is something wrong with the user's hearing caused by a minute difference in how the hearing aid is mounted will be eliminated, and this improves the user's sense of satisfaction with his hearing. Accordingly, the present invention is expected to find wide application as a hearing aid.

REFERENCE SIGNS LIST

1 main body case
2 ear hook
3 receiver
4 control device
5 battery
6 power switch
7 volume control
8 external microphone
9 mounting correction switch
10 ear canal microphone
11 mounting piece
12, 13 acoustic tube
14 ear canal
15 ear (auricle)
16 hearing aid processor
17 correction component
18 transmission characteristic calculator
19 at-fitting transmission characteristic storage
20 correction-use sound data storage
21 correction characteristic calculator
22, 23, 24 amplifier
25, 26 A/D converter
27 D/A converter
28 in-usage transmission characteristics storage
29 correction characteristic storage
30 sound reproduction processor
31 correction sound-use speaker
32 D/A converter
33 amplifier
34 ear plug
T through-hole

The invention claimed is:

1. A hearing aid, comprising:

an external microphone configured to collect sound outside the ear canal;

an ear canal microphone configured to collect sound inside the ear canal;

a hearing aid processor configured to subject input sound data indicating the sound collected by the external microphone to hearing aid processing on the basis of fitting information set by fitting;

a correction-use sound output component configured to output correction-use sound on the basis of correction-use sound data;

an interface arranged to be operated by a user;

a transmission characteristic calculator configured to calculate an at-fitting transmission characteristic on the basis of first sound data and second sound data when the hearing aid is set for fitting, the first sound data produced by collection at the ear canal microphone of the correction-use sound outputted from the correction-use sound output component, and the second sound data corresponding to the correction-use sound data, the transmission characteristic calculator configured to calculate an in-usage transmission characteristic on the basis of third sound data and fourth sound data when the hearing aid is actually used by user after the hearing aid has been set for fitting, the third sound data produced by collection at the ear canal microphone of the correction-use sound outputted from the correction-use sound output component according to user operation, and the fourth sound data corresponding to the correction-use sound data;

a correction characteristic calculator configured to calculate a correction characteristic on the basis of the at-fitting transmission characteristic and the in-usage transmission characteristic; and a correction component configured to correct the input sound data undergone hearing aid processing by the hearing aid processor, on the basis of the correction characteristic, wherein:

the transmission characteristic calculator is configured to calculate the at-fitting transmission characteristic on the basis of a ratio of the first sound data to the second sound data, and the in-usage transmission characteristic on the basis of a ratio of the third sound data to the fourth sound data; and the correction characteristic calculator is configured to calculate the correction characteristic on the basis of a ratio of the at-fitting transmission characteristic to the in-usage transmission characteristic.

2. The hearing aid according to claim 1, comprising a receiver configured to be mounted in the inlet to the ear canal or inserted into the ear canal, and the receiver configured to output speech into the ear canal according to the input sound data corrected by the correction component, wherein the correction-use sound output component is the receiver, and the second sound data and the fourth sound data are the correction-use sound data.

3. The hearing aid according to claim 1, comprising an external speaker configured to be disposed outside the ear canal, and the external speaker configured to output speech outside the ear canal, wherein the correction-use sound output component is the external speaker, and the second sound data and the fourth sound data are produced by collection at the external microphone of the correction-use sound outputted from the correction-use sound output component.

4. The hearing aid according to claim 3, comprising an ear plug configured to be mounted in the inlet to the ear canal or inserted into the ear canal, and in which the ear canal microphone is embedded, wherein the ear plug has a through-hole communicating between the inside of the ear canal and the outside of the ear canal.

5. The hearing aid according to claim 1, wherein the interface is constituted by a single button, and the transmission characteristic calculator calculates the in-usage transmission characteristic when the user has pressed the button a specific number of times.

* * * * *